US009423196B2

(12) United States Patent
Kunau

(10) Patent No.: US 9,423,196 B2
(45) Date of Patent: Aug. 23, 2016

(54) GAP SEAL FOR PROJECTILE LAUNCHING DEVICE

(71) Applicant: Daniel Kunau, Paragould, AR (US)

(72) Inventor: Daniel Kunau, Paragould, AR (US)

( * ) Notice: Subject to any disclaimer, the term of this patent is extended or adjusted under 35 U.S.C. 154(b) by 0 days.

(21) Appl. No.: 14/938,821

(22) Filed: Nov. 11, 2015

(65) Prior Publication Data

US 2016/0061543 A1 Mar. 3, 2016

Related U.S. Application Data

(63) Continuation of application No. PCT/US2013/078387, filed on Dec. 30, 2013.

(51) Int. Cl.
*F41A 3/76* (2006.01)
*F41C 3/14* (2006.01)

(52) U.S. Cl.
CPC .. *F41A 3/76* (2013.01); *F41C 3/14* (2013.01)

(58) Field of Classification Search
CPC ..... F41A 3/74; F41A 3/76; F41C 3/14; F41B 11/70
USPC ..... 89/26, 155; 42/59
See application file for complete search history.

(56) References Cited

U.S. PATENT DOCUMENTS

| | | | | |
|---|---|---|---|---|
| 325,878 | A | 9/1885 | Tyler | |
| 1,965,637 | A | 7/1934 | Frederick et al. | |
| 2,801,573 | A * | 8/1957 | Herlach | F41A 3/76 89/13.05 |
| 2,938,458 | A | 5/1960 | O'Brien | |
| 2,981,023 | A | 4/1961 | Sergay | |
| 3,136,084 | A | 6/1964 | Charron | |
| 3,159,938 | A | 12/1964 | Treat, Jr. et al. | |
| 3,613,500 | A * | 10/1971 | Warin | F41A 3/74 89/26 |
| 3,768,362 | A * | 10/1973 | Grimm | F41A 3/76 89/26 |
| 4,455,777 | A | 6/1984 | Callies | |
| 5,048,216 | A | 9/1991 | Casull | |
| 5,160,795 | A | 11/1992 | Milliman | |
| 5,333,531 | A | 8/1994 | Field | |
| 5,400,536 | A | 3/1995 | Milliman | |
| 6,658,780 | B2 | 12/2003 | Papadimas | |
| 8,459,166 | B2 | 6/2013 | Herrmann et al. | |
| 8,621,772 | B1 | 1/2014 | Kunau | |
| 8,752,319 | B2 | 6/2014 | Kunau | |

FOREIGN PATENT DOCUMENTS

| | | |
|---|---|---|
| RU | 2147718 | 4/2000 |
| RU | 79169 | 12/2008 |

* cited by examiner

*Primary Examiner* — Reginald Tillman, Jr.
(74) *Attorney, Agent, or Firm* — Brevetto Law Group

(57) ABSTRACT

A projectile launching device includes a barrel with a bore through the barrel, and a breach end opposite of a muzzle end. A feed mechanism, with a chamber to hold a projectile, is positioned at the breach end of the barrel. The feed mechanism is moveable between a first position with the chamber and the barrel unaligned, and a second position with the chamber and the barrel aligned. A receiver is positioned on an opposite side of the feed mechanism from the barrel. The receiver includes a gas duct to convey gas into the chamber to fire the projectile. A sleeve is slidingly coupled to the receiver and is adapted to forcibly slide into a position in contact with the feed mechanism, in response to pressure from the gas conveyed through the gas duct, to seal a first gap between the receiver and the feed mechanism.

20 Claims, 5 Drawing Sheets

GAP SEAL FOR PROJECTILE LAUNCHING DEVICE

CROSS-REFERENCE TO RELATED APPLICATIONS

This application is a continuation of International Patent Application No. PCT/US2013/078387 filed on Dec. 30, 2013, which is hereby incorporated by reference in its entirety for any and all purposes.

BACKGROUND

1. Technical Field

The present subject matter relates to projectile launching devices which have a gap between the feed mechanism and the barrel. More particularly it relates to sealing the gap between the chamber of the feed mechanism that is aligned with the barrel, and the barrel, as a projectile is fired from the chamber and through the barrel.

2. Background Art

A revolver is the least expensive, shortest, lightest and most reliable multi-shot action gun available. Revolvers however do have their disadvantages. Many of these disadvantages relate to the revolver gap, i.e. the gap between the barrel and the revolving cylinder, or more particularly the gap between the barrel and the front of the chamber in the revolving cylinder which is aligned with the barrel. Unlike many other firearms where the cartridges—each comprising a shell, filled with gun powder, and topped with a bullet, are individually and successively positioned within a firing chamber attached to the barrel; it has generally been accepted that the revolver gap is an inherent weakness in a revolver, necessitated by the need to provide clearance between the revolving cylinder and the barrel.

One of the biggest disadvantages associated with the revolver gap is safety. People have been injured by lead pieces and burned by flame gases escaping through the revolver gap. Another disadvantage of the revolver gap is the energy lost as the combustion gas escapes through the revolver gap. The loss of energy results in decreased muzzle velocity and energy of the bullet. The loss of combustion gas through the revolver gap can also result in inconsistent combustion in the chamber. This results in inconsistent muzzle velocity which can impact shot accuracy. Other disadvantages of the revolver gap include limitations on powder load, limitations on effective barrel lengths, and a high noise level that is not directed away from the shooter.

Various alternatives have been suggested in the past to solve this problem, going back at least to a patent by John E. Tyler granted on Sept. 8, 1885 as U.S. Pat. 325,878, but none have been practical or effective enough to be included in high-volume revolvers sold today.

BRIEF DESCRIPTION OF THE DRAWINGS

The accompanying drawings, which are incorporated in and constitute part of the specification, illustrate various embodiments. Together with the general description, the drawings serve to explain various principles. In the drawings.

DETAILED DESCRIPTION

Figure 1:
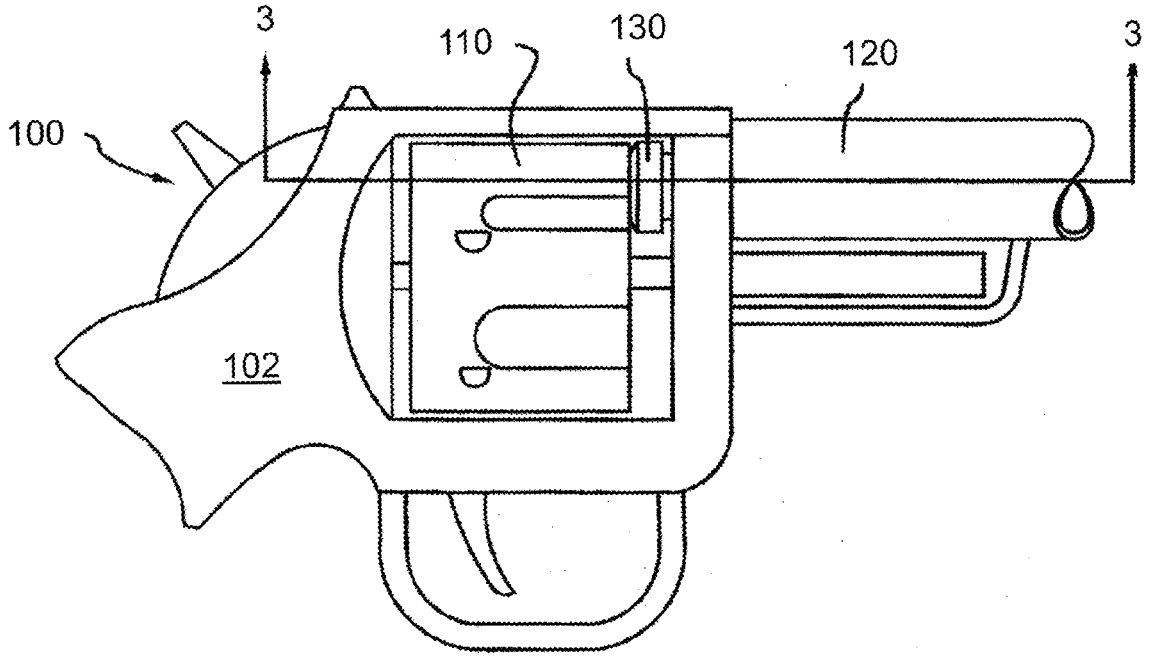
FIG. 1 is a side view of an embodiment of a revolver having a gap seal positioned over a diametrically reduced breech end portion of the barrel in front of the revolver cylinder.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures and components have been described at a relatively high-level, without detail, in order to avoid unnecessarily obscuring aspects of the present concepts. A number of descriptive terms and phrases are used in describing the various embodiments of this disclosure. These descriptive terms and phrases are used to convey a generally agreed upon meaning to those skilled in the art unless a different definition is given in this specification. Some descriptive terms and phrases are presented in the following paragraphs for clarity.

A projectile launching device, as the term is used herein and in the claims, is an apparatus that launches a projectile, such as a metallic bullet, a rubber bullet, a tear gas canister, a pepper gas ball, a ball or canister holding any type of material, a bean bag, a weighted net, a t-shirt, a paint ball, a dart, an arrow, or any other type of projectile, from a chamber in a feed mechanism out through a barrel, using gas pressure. The gas pressure may be created using combustion, such as from exploding gun powder, using some other chemical reaction, by releasing gas from a pressurized gas reservoir, or by other methods, depending on the embodiment. As used herein, the term "gun" is synonymous with "projectile launching device." Examples of projectile launching devices include, but are not limited to, firearms of various varieties, airguns of various varieties, t-shirt launchers, paint ball markers, and riot control guns for firing atypical projectiles. One specific example of a projectile launching device is a revolver, which is a type of handgun firearm.

A feed mechanism, as the term is used herein and in the claims, is a mechanism that contains at least one chamber for holding at least a projectile for firing by the projectile launching device of which the feed mechanism is a part, and to align the chamber with the barrel of the projectile launching device for firing. In many embodiments, the feed mechanism is a moveable part within the projectile launching device. Two examples of feed mechanisms are a revolving cylinder and a sliding block, although the term should not be limited to those two examples.

The term substantially, as used herein and in the claims, means much more than a majority, and may be taken to mean three-quarters or more. The term frame is a generic term, and may refer to any part of the projectile launching device other than the feed mechanism, the gap seal, and the barrel, depending on the embodiment. The term gas is meant to describe non solid phases of matter, including at least a gaseous phase and a plasma phase.

As is described above, revolvers have a revolver gap that can cause a variety of problems. Other types of projectile launching devices have similar gaps between the feed mechanism and the barrel due to designs that require the feed mechanism to move freely past the breech end of the barrel. If the gap could be sealed during the firing of the projectile from the chamber and through the barrel, keeping the gas in the barrel behind the projectile as it travels down the barrel, there could be many different advantages. If the gap was sealed, a firearm, such as a revolver, would be safer due to the reduction or elimination of hot gas and/or bits of hot lead shooting through the gap at a high temperature and rate of speed. Any type of projectile launching device that has a gap between the feed mechanism and the barrel would have increased projectile velocity and energy if the gap is sealed and the energy from expanding gas is transferred to the projectile instead of lost through the gap. Accuracy and consistency could also be increased due to less variability due less energy loss through the gap. Other potential advantages of sealing the gap include: higher pressure cartridges could be used more effectively; benefits of longer gun barrels could be realized; firearms with a gap would be quieter for the shooter, moving sound away from the shooter's face; revolvers could be more cost effective; revolvers could be cheaper to manufacture due to less precise tolerances being needed between the revolving cylinder and the barrel; and, revolver carbine rifles could become safer, more effective, and practical. Several different embodiments to close, or seal, the gap between the feed mechanism and the barrel are described herein.

In one embodiment, a single-piece sleeve is positioned to slide over a breech end portion of the barrel. As a projectile is fired from a chamber of the feed mechanism, through the barrel, gas pressure acts on the sleeve to slide it forcibly back against the feed mechanism, sealing the gap between the feed mechanism and the barrel. The gas pressure operates on one or more parts of the sleeve, such as, but not limited to, an end surface of the sleeve, and/or an inside surface of a face of the sleeve. The sleeve may have an optional ring seal interposed between the sleeve and the breech end portion of the barrel or some other part of the projectile launching device to minimize gas escaping from around the sleeve while minimizing sliding friction. Any type of movable feed mechanism can be used with this embodiment, including but not limited to, a revolving cylinder with multiple chambers, a reciprocating sliding block with a one or two chambers, a linear sliding rail with multiple chambers, or a chain of blocks having a single chamber each. The feed mechanism has at least two positions, one where a chamber is aligned with the barrel, and one where that chamber is not aligned with the barrel. The movement of the feed mechanism means that a gap is necessary to facilitate the movement of the feed mechanism past the breech end of the barrel. This embodiment with the sleeve between the feed mechanism and the barrel may be suitable at least for firearms, such as a revolver, where the gas pressure is generated by combustion of gun powder and the back end of the chamber is sealed by some mechanism such as holding the shell of the cartridge tightly in the chamber. Some implementations of this embodiment include an enlargement in a breech end portion of the bore of the barrel so that the central opening through the face of the sliding sleeve, sized marginally larger than the bore, will thereby catch a periphery of a compressed airstream ahead of a fired bullet, as well as the hot combustion gases after the bullet passes therethrough.

In another embodiment, a sleeve is positioned on an opposite side of the feed mechanism from the barrel. Gas pressure is provided, through a central opening of the sleeve, to the chamber behind the projectile. The gas pressure acts on the sleeve to slide it forcibly forward against the feed mechanism, pushing the feed mechanism forward against the barrel, sealing the gap between the feed mechanism and the barrel. The gas pressure operates on one or more parts of the sleeve, such as, but not limited to, an end surface of the sleeve, and/or an inside surface of a face of the sleeve. The sliding of the sleeve also seals any gap between the feed mechanism and the frame, or receiver, located opposite of the feed mechanism from the barrel. As with the earlier described embodiment, this embodiment can be used with any type of moveable feed mechanism and may include an optional ring seal. This embodiment with the sleeve opposite of the feed mechanism from the barrel may be suitable at least for airguns, where the gas pressure is introduced into the chamber from the side opposite from the barrel and a second gap exists between the feed mechanism and the frame, receiver, gas duct, or some other part of the projectile launching device opposite the feed mechanism from the barrel. Examples of such an airgun include at least some types of paint ball markers, or riot control guns launching projectiles such as tear gas balls, pepper gas balls, bean bags, or rubber bullets.

Reference now is made in detail to the examples illustrated in the accompanying drawings and discussed below.

FIG. 1 through 4 show different views of the same embodiment of a gap seal for a projectile launching device, in this case a revolver 100. Other embodiments that use a different type of feed mechanism than the revolving cylinder 110 shown, including, but not limited to, a sliding block, may use the same embodiment of a gap seal. FIG. 1 shows a side view of an embodiment of a revolver 100 having a gap seal, such as the sleeve 130, positioned over a diametrically reduced breech, or rear, portion of the barrel 120 in front of the revolving cylinder 110. In some embodiments, the revolver includes a frame 102 to provide structure to position the various other parts of the revolver 100. The revolver 100 includes a barrel 120 that is attached to the frame, but other embodiments may integrate the barrel and frame into a single unit. The barrel 120 has a breech, or rear, end, which is oriented toward the revolving cylinder 110, and a muzzle end which is opposite the breech end. A revolving cylinder 110, which is a type of a feed mechanism, includes multiple cartridge chambers distributed around the cylinder 110, and is positioned in the frame 102 and configured to rotate around an axis that is parallel with the barrel 120. The revolving cylinder 110 is positioned so that there is a gap between the revolving cylinder 110 and the breech end of the barrel 120 to allow the cylinder 110 to rotate freely. Depending on the embodiment, the revolving cylinder 110 can have any number of chambers, but many embodiments include 5 or 6 chambers. The revolving cylinder 110 is configured to hold and sequentially and longitudinally align each chamber with the breech end of the barrel 120. So the revolving cylinder 110 has at least a first position where a particular chamber is not aligned with the barrel 120, and a second position where that particular chamber is aligned with the barrel 120 to facilitate firing a projectile from the chamber through the barrel 120.

The revolver 100 also includes a sliding sleeve 130 that is positioned over a breech end portion of the barrel 120. The sleeve 130 is made of a single piece of material, such as steel, and is able to slide over the breech end portion of the barrel 120. In at least one embodiment, the sleeve 130 is closely mated to the breech end portion of the barrel 120, but in some embodiments, a ring seal may be used between the sleeve 130 and another part of the revolver 100 to reduce sliding friction while maintaining a seal between the sleeve 130 and the other part of the revolver 100, such as the breech end portion of the barrel 120. Even if a ring seal is added to the sleeve 130, the sleeve 130 is still considered to be a single-piece sleeve, at least for the purposes of this disclosure and claims.

The sleeve 130 forcibly slides into a position in contact with the revolving cylinder 110 in response to gas pressure created in firing a projectile from a chamber of the revolving cylinder 110 through the barrel. Once the sleeve 130 is in contact with the revolving cylinder 110, the gap between the revolving cylinder 110 and the barrel 120 is sealed by the sleeve 130. Sealing the gap prevents the expanding gas that propels the projectile through the barrel 120 from escaping through the gap, and may increase the muzzle velocity of the projectile as well as to make the muzzle velocity more consistent. This also makes the revolver 100 safer and more comfortable to use. It should be noted that the use of the word "seal" and its derivatives herein, including the claims, is not meant to imply that no gas at all can escape. As long as most of the gas that could escape through the gap if the sleeve 130 did not slide is blocked by the sliding sleeve 130, the gap should be considered to be sealed for the purposes of this disclosure, including the claims.

Figure 2:
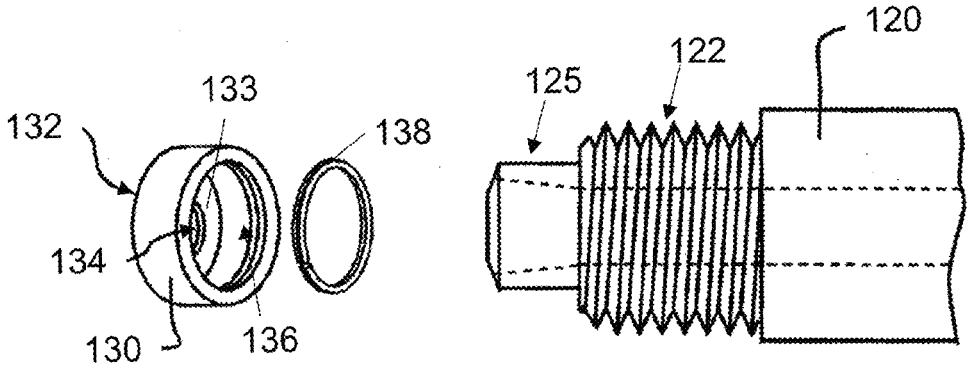
FIG. 2 is a perspective exploded view of a breech end portion of the barrel and the sleeve of the embodiment shown in FIG. 1.

FIG. 2 is a perspective exploded view of a breech end portion 125 of the barrel 120 and sleeve 130, of the embodiment shown in FIG. 1. The barrel 120 includes threads 122 that can be used to attach the barrel 120 to the frame 102 of the revolver 100 in embodiments. The breech end portion 125 of the barrel 120 may be diametrically reduced from the diameter of the rest of barrel 120 in at least some embodiments. The barrel 120 has a bore running from the breech end to the muzzle end to direct a projectile that is fired from the revolver 100. The sleeve 130, which acts to seal the gap between the revolving cylinder 110 and the breech end of the barrel 120, is a single piece of material and is sized so that the inner diameter 136 can fit over the breech end portion 125 of the barrel 120. In some embodiments, the inner diameter 136 of the sleeve 130 is sized to closely mate with the breech end portion 125 of the barrel 120, but in other embodiments, a ring seal 138 may be positioned between the sleeve 130 and the breech end portion 125 of the barrel 120. The meaning of "single-piece sleeve" herein and in the claims, is that the sleeve 130 is not separable into two or more pieces without breaking or cutting the material of the sleeve 130. The sleeve 130 may be manufactured from a single piece of material, or may be manufactured from multiple pieces of material joined together, and still be considered a single-piece sleeve 130. Even if a ring seal 138 is added, the sleeve should still be considered a single-piece sleeve, because a single piece surrounds the breech end portion 125 of the barrel 120. As long as at least a portion of the sleeve 130 completely encircles the breech end portion 125 of the barrel 120, the sleeve 130 should be considered a single-piece sleeve.

The sleeve 130 has a face 132 that is oriented toward the revolving cylinder 110. The face 132 has a central opening 134, or hole, through the face 132.An inside surface 133 of the face 132 forms an annular ring around the central opening 134. The inside surface 133 may be parallel with the face 132, or may be at an angle to the face 132, tapering the thickness of the face depending on the distance from the central opening 134. The gas pressure from firing the projectile acts on the inside surface 133 to forcibly drive the face 132 of the sleeve 130 against the revolving cylinder 110.

Figure 3:
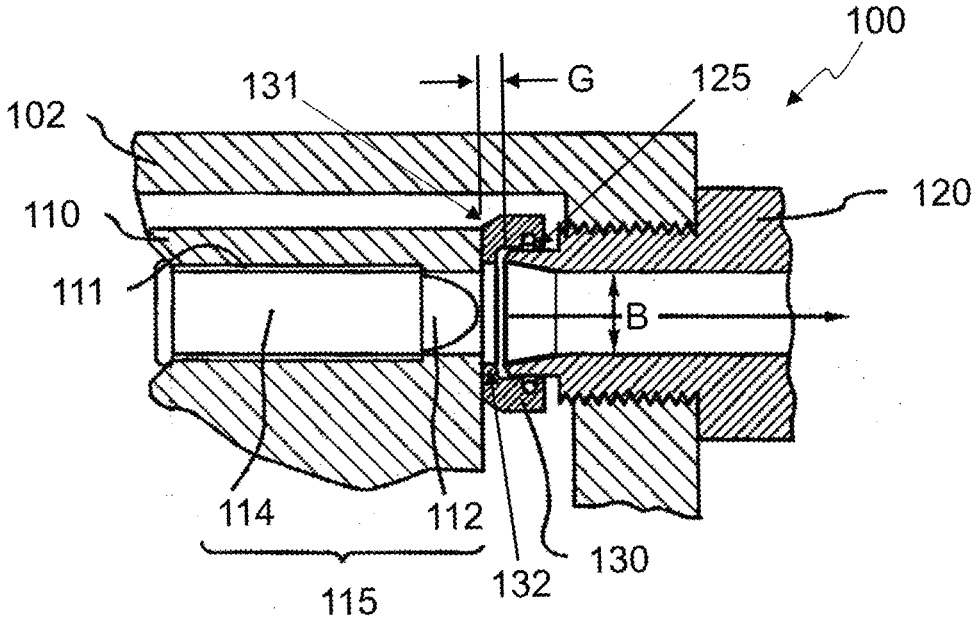
FIG. 3 is a partial cross sectional view of the gun frame, the revolver cylinder, sleeve, and breech end portion of the barrel as taken along line 3-3 of the embodiment shown in FIG. 1.

FIG. 3 is a partial cross sectional view of the gun frame 102, the revolver cylinder 110, the sleeve 130, and a breech end portion 125 of the barrel 120 as taken along line 3-3 of the embodiment shown in FIG. 1. A chamber 111 of the revolving cylinder 110 contains a cartridge 115 therein, the cartridge 115 including a shell 114 containing gun powder and carrying a bullet 112 in the front end of the cartridge 115. The revolving cylinder 110 is positioned so that there is a gap G between the revolving cylinder 110 and the breech end of the barrel 120 to allow the revolving cylinder 110 to rotate freely. The revolving cylinder is rotated so that the chamber 111 is aligned with the breech end of the barrel 120.

The sleeve 130 is positioned over the breech end portion 125 of the barrel 120 and is able to slide forward and back for at least some distance over the breech end portion 125 of the barrel 120. The face 132 of the sleeve 130 is interposed between the revolving cylinder 110 and the breech end of the barrel 120, so the thickness of the face 132 is less than the gap G and the sleeve 130 is able so slide back over the breech end portion 125 of the barrel 120 at least far enough that the face 132 is in contact with the revolving cylinder 110. Before the bullet 112 is fired, there is little to no force on sleeve 130 pushing the sleeve 130 against the revolving cylinder 110, so even if the sleeve 130 is in contact with the revolving cylinder 110, the revolving cylinder 110 can still rotate freely. The optional chamfer 131 around the outer edge of the face 132 helps to minimize any interference between the sleeve 130 and the revolving cylinder 130.

If the bullet 112 is fired by igniting the gun powder in the shell 114, the bullet 112 moves rapidly from the chamber 111 into the bore B of the barrel 120. In some cases, the bullet 112 may move quickly enough to generate gas pressure in front of the bullet 112 which may act on the inside surface 133 of the face 132 of the sleeve 130 and force the sleeve 130 back against the revolving cylinder 110. Once the bullet 112 has entered the bore B of the barrel 120, the hot combustion gas from the exploding gun powder fills the chamber 111 and the bore B of the barrel 120 behind the bullet 112. In a standard revolver, some of the hot combustion gas escapes through the gap between the revolving cylinder and the barrel. In the revolver 100 shown in FIG. 1, the gas pressure from the exploding gun powder acts on the inside surface 133 of the face 132 of the sleeve 130 to force the sleeve 130 against the revolving cylinder 110 to seal the gap G between the revolving cylinder 110 and the breech end of the barrel 120. The optional ring seal 138 may also help prevent gas from escaping from between the sleeve 130 and the breech end portion 125 of the barrel 120. Depending on the embodiment, some of the combustion gas may still escape through the gap G, but the sleeve 130 prevents a majority of the gas that would otherwise have escaped from escaping because of the pressure forcibly holding the face 132 of the sleeve 130 tightly against the revolving cylinder 110. Once the bullet 112 has exited the muzzle of the barrel 120, the gas pressure drops, releasing the force on the inside surface 133 of the face 132 of the sleeve 130 so that the sleeve is no longer forcibly maintained in the position in contact with the revolving cylinder 110.

Figure 4:
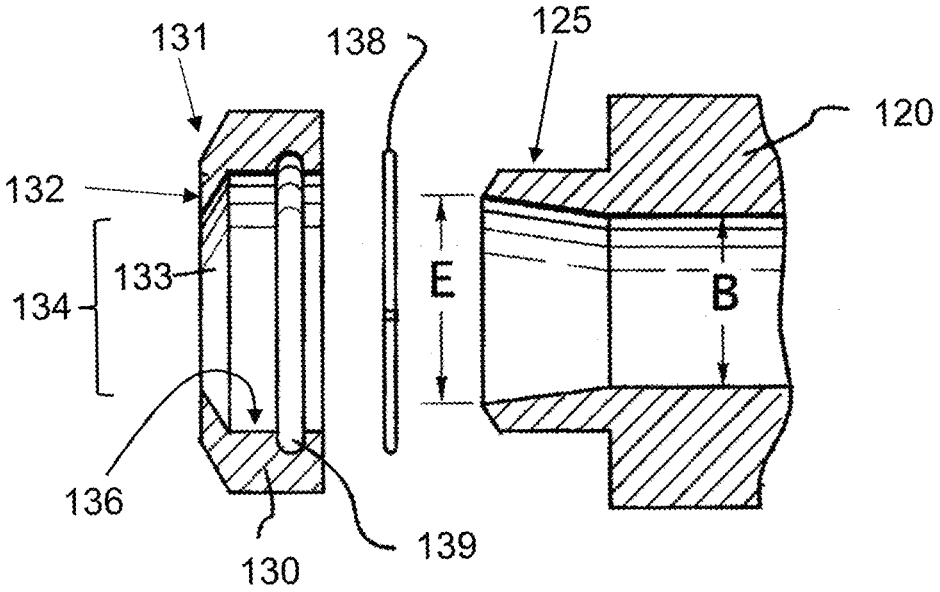
FIG. 4 is an enlarged cross sectional exploded view of the breech end portion of the barrel and the gap seal of the embodiment shown in FIG. 1.

FIG. 4 is an enlarged cross sectional exploded view of a breech end portion 125 of the barrel 120 and the sleeve 130 of the embodiment shown in FIG. 1. The threads 122 of the barrel 120 are not shown for simplicity. In some embodiments, the bore B of the barrel 120 has an enlarged diameter E at the breech end of the barrel 120. The enlarged diameter E may be helpful in directing the bullet 112 into the bore B if the chamber 111 is not exactly aligned with the bore B. The sleeve 130 has an inner diameter 136 that is sized to fit over the breech end portion 125 of the barrel 120, and in some embodiments, is sized to be closely mated to the breech end portion 125 of the barrel 120 to minimize the amount of gas that can escape between the sleeve 130 and the breech end portion 125 of the barrel 120.

The sleeve 130 of some embodiments includes an interior peripheral groove 139 within the sliding sleeve 130, in the inner diameter 136 of the sleeve 130. A ring seal 138, which may be a split ring in some embodiments, is positioned in the interior peripheral groove 139, and slides over and along the breech end portion 125 of the barrel 120. The ring seal 138 may further minimize the amount of gas that can escape between the sleeve 130 and the breech end portion 125 of the barrel 120 and may help to minimize friction by reducing the sliding contact area.

The sleeve 130 includes a face 132, which is the end of the sleeve 130 that is oriented toward the revolving cylinder 110. The outer edge of the face 132 may include a chamfer 131 to let any gas that does escape between the revolving cylinder 110 and the face 132 of the sleeve 130 to begin to expand and lose energy. The face 132 includes a central opening 134 that has a size that can range from about the size of the diameter of the bore B, to the diameter of the inside diameter 136 of the sleeve 130, depending on the embodiment. In the embodiment of FIG. 1-4, the central opening 134 is smaller than the inside diameter 136 of the sleeve 130, forming an inside surface 133 of the face 132.

If the sleeve 130 is used in conjunction with an enlarged diameter E in a breech end of the bore B of the barrel 120, then the central opening 134 through the face 132 of the sliding sleeve 130, which may be sized marginally larger than the bore B, may thereby catch a periphery of a compressed airstream ahead of a fired bullet 112, as well as the hot combustion gases after the bullet 112 passes therethrough. The arrangement shown in FIG. 1-4 may be effective for revolvers 100 of bores B most commonly used.

So in a revolver 100, as shown in FIG. 1-4, having a frame 102, carrying a barrel 120 and a revolving cylinder 110 having multiple cartridge chambers 111 therearound, each configured to hold and sequentially and longitudinally align a cartridge 115 therein carrying a bullet 112 with a breech end of the barrel 120, an improvement includes: a) a sliding sleeve 130 positioned over a breech end portion 125 of the barrel 120, said breech end portion 125 of the barrel 120 and an inner diameter 136 of the sliding sleeve 130 closely mated, and b) said sliding sleeve 130 having a face 132 having a central opening 134 therethrough having the inner diameter nominally equivalent to marginally larger than, a bore B through the barrel 120. Whereafter firing, the sliding sleeve 130 is instantaneously, and directly driven back, substantially by gas pressure until the face 132 of the sliding sleeve 130 makes contact with the revolving cylinder 110, thereby eliminating any gap G between the revolving cylinder 110 and the barrel 120, preventing exploding gas from escaping therethrough, and substantially increasing bullet 112 discharge velocity and energy, and subsequently, after the bullet 112 is fully discharged, and gas pressure drops, said sleeve 130 is no longer forcibly maintained in a gap eliminating position.

Figure 5:
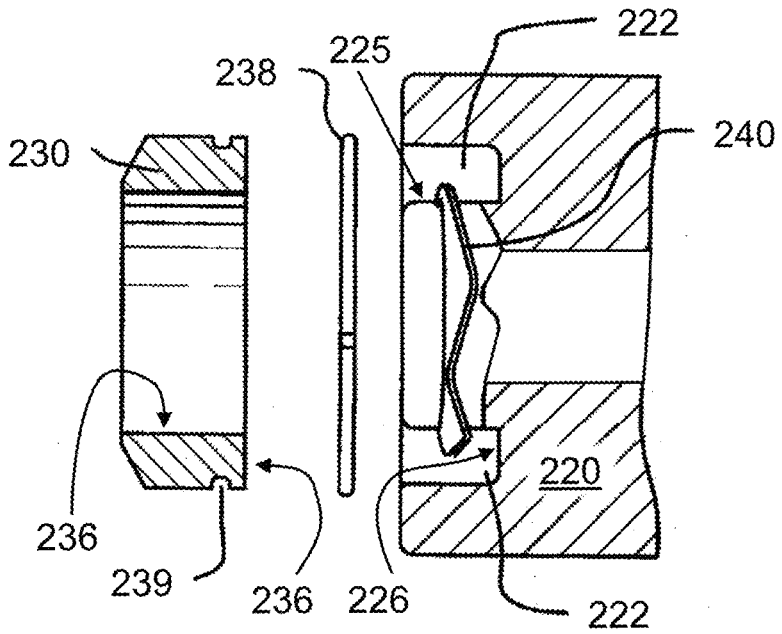
FIG. 5 is an enlarged partial cross sectional exploded view of an alternative embodiment of a breech end portion of the barrel and a gap seal.

FIG. 5 is an enlarged partial cross sectional exploded view of an alternative embodiment of a breech end portion of the barrel 220 and a gap seal, or sleeve 230. A feed mechanism, which is not shown in FIG. 5, is located across a gap from the sleeve 230, on the opposite side of the sleeve 230 from the barrel 220. The embodiment shown in FIG. 5 may be suitable for large bore projectile launching devices, including shot gun revolvers which generally have not been practical due to problems with the revolver gap, mostly for safety reasons. It is noted that with the sliding sleeve 230 sealing the revolver gap it is possible to use the revolver format for a shot gun. It should be noted that this embodiment may also be suitable for a variety of projectile launching devices using either a revolving cylinder or some other type of feed mechanism, including, but not limited to, a sliding block.

In the embodiment shown in FIG. 5, the ring seal 238 is positioned within an exterior peripheral groove 239 around the sliding sleeve 230, and the periphery of the ring seal 238 slides within and along a recessed circular groove 222 around the breech end portion 225 of the barrel 220. It is noted that the recessed circular groove 222 may be either within an end portion of the barrel 220, or within the frame therearound, or partially within the frame and the end portion of the barrel 220, or within some other part of the projectile launching device. Therefore, the sliding sleeve 130 may also include a ring seal 238 positioned between the sliding sleeve 230 and one of the breech end portion of the barrel 220 and the gun frame. In the embodiment shown, the central opening is the face of the sleeve 230 is the same size as the inner diameter of the sleeve 230.

In some embodiments, a bias means, such as the spring washer 240, is positioned over and around the breech end portion of the barrel 220 to urge the face of the sliding sleeve 230 against the feed mechanism, such as a revolving cylinder, prior to firing. In some embodiments, the spring washer 240 is positioned such that is does not push the sleeve 230 against the feed mechanism, but simply creates a space between the muzzle-facing surface 236 of the sleeve 230 and the recessed circular groove 222 around the breech end portion 225 of the barrel 220, specifically, a space between the muzzle-facing surface 236 of the sleeve 230 and the muzzle-end surface 226 of the recessed circular groove 222 around the breech end portion 225 of the barrel 220. Other embodiments may use different spacing mechanisms to create the space between the muzzle-facing surface 236 of the sleeve 230 and the recessed circular groove 222 around the breech end portion 225 of the barrel 220, such as, but not limited to, a difference between the contour of the muzzle-facing surface 236 of the sleeve 230 and a shape of the recessed circular groove 222 around the breech end portion 225 of the barrel 240, various types of washers or spacers, or any other mechanism.

In the embodiment of FIG. 5, the gas pressure created in firing the projectile causes gas to flow between the feed mechanism and the breech end of the barrel 220 and between the breech end portion 225 of the barrel 220 and an inner diameter 236 of the sleeve 230 to pressurize gas in a space between the muzzle-facing surface of the sleeve 236 and the recessed circular groove around the breech end portion 225 of the barrel 220, specifically, a space between the muzzle-facing surface 236 of the sleeve 230 and the muzzle-end surface 226 of the recessed circular groove 222 around the breech end portion 225 of the barrel 220. The pressurized gas in the space acts on the muzzle-facing surface 236 of the sleeve to forcibly slide the sleeve 230 into the position in contact with the feed mechanism.

Figure 6:
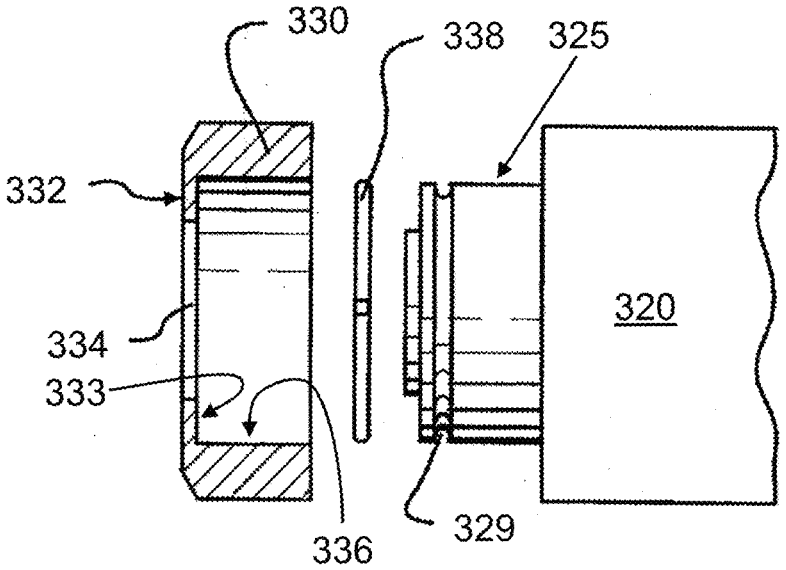
FIG. 6 is an enlarged partial cross sectional exploded view of another alternative embodiment of a breech end portion of the barrel and a gap seal.

FIG. 6 is an enlarged partial cross sectional exploded view of another alternative embodiment of a breech end portion of the barrel 320 and a gap seal 330. This embodiment may be effective for smaller bore projectile launching devices. It should be noted that this embodiment may also be suitable for a variety of projectile launching devices using either a revolving cylinder or some other type of feed mechanism, including, but not limited to, a sliding block. Herein, the ring seal 338 is positioned within an exterior peripheral groove 329 around the breech end portion 325 of the barrel 320, and the periphery of the ring seal 338 slides along and within the inner diameter 336 of the sliding sleeve 330. The sleeve 330 includes a face 332 with a central opening 334 that is smaller than the inner diameter 336 of the sleeve 330 to create an inside surface 333 to be acted on by the gas pressure to force the sleeve 330 against the feed mechanism.

Figure 7:
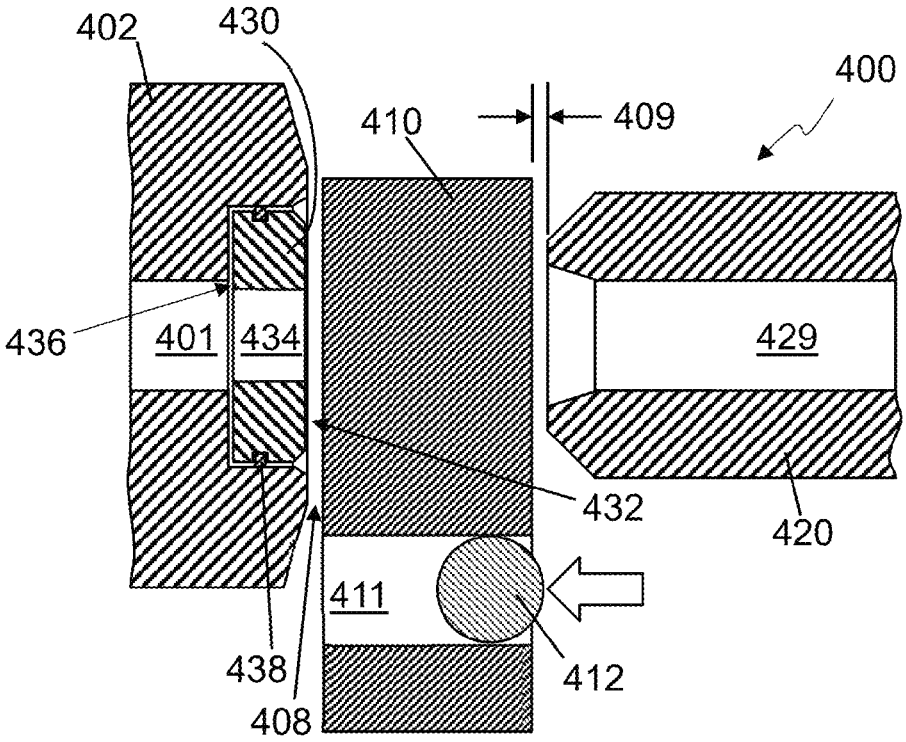
FIG. 7 is a cross-sectional view of a portion of an embodiment of a projectile launching device with a sliding block feed mechanism in the loading position.
Figure 8:
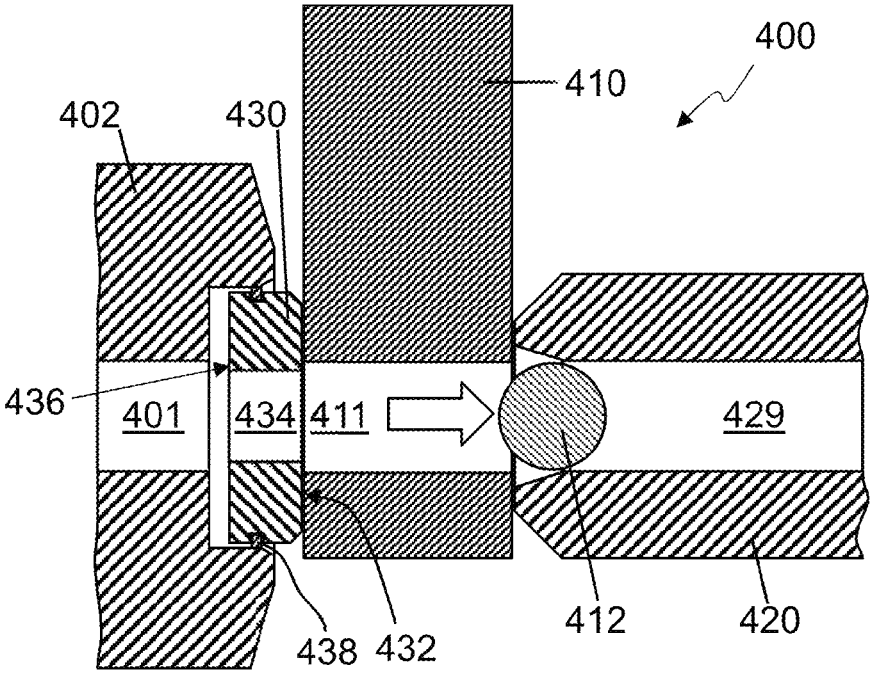
FIG. 8 is a cross-sectional view of a portion of the embodiment of the projectile launching device of FIG. 7, where the sliding block feed mechanism is in the firing position.

FIGS. 7 and 8 are cross-sectional views of a portion of an embodiment of a projectile launching device 400 with a sliding block feed mechanism 410 in the loading position and firing position, respectively. The projectile launching device includes a frame or some other type of structure to hold the receiver 402 and barrel 420 in a fixed position with respect to one another on opposite sides of the feed mechanism 410, although in some embodiments, the receiver 402 and/or barrel 420 may be integrated with the frame. In the embodiment shown, a sliding sleeve 430 is positioned in a cavity of the receiver 402 that is pneumatically coupled to a duct 401, so that the sliding sleeve 430 is located between the receiver 402 and the feed mechanism 410. As such, the sleeve 430 is positioned on an opposite side of the feed mechanism 410 from the barrel 420. In some embodiments, the sleeve 430 may include a ring seal 438, which may be a split ring, positioned between the sleeve 430 and the receiver 402. The ring seal 438 may be positioned within an exterior peripheral groove around the sleeve and configured to closely mate to and slide within cavity of the receiver.

The feed mechanism 410 is configured to be able to slide between a first position, which can be a loading position in some embodiments, as shown in FIG. 7, and a second position, or firing position, as shown in FIG. 8. In the loading position, the projectile 412 may be introduced into the chamber 411 by gravity, a spring, a lever, gas pressure, or by any other method, depending on the embodiment. In the firing position, the chamber 411 is aligned with the bore 429 of the barrel 420. In some embodiments, the feed mechanism 410 has multiple chambers and multiple firing positions and may be loaded in one or more loading positions or may be loaded before it is positioned in between the receiver 402 and the barrel 420. Various embodiments may use various types of feed mechanisms including but not limited to, a revolving cylinder with multiple chambers, a reciprocating sliding block with a one or two chambers as shown in FIG. 7/8, a linear sliding rail with multiple chambers, or a chain of blocks having a single chamber each. To facilitate the movement of the feed mechanism 410, a first gap 408 is provided between the receiver 402 and the feed mechanism 410, and a second gap 409 is provided between the barrel 420 and the feed mechanism 410. The feed mechanism 410 may be moved between the first position and the second position manually, by motor, by gas pressure, or by any other method, depending on the embodiment.

The receiver includes a gas duct 401 to provide gas pressure, through a central opening 434 of the sleeve 430 and into the chamber 411 of the feed mechanism 410, to fire the projectile 412 from the chamber 411 and through the bore 429 of the barrel 410. The gas pressure can be provided by any method, including, but not limited to, igniting gun powder, mixing substances to produce gas from a chemical reaction, or releasing gas from a pressurized gas reservoir coupled to the gas duct 401 of the receiver 402. The sleeve 430 is configured to slide within the cavity of the receiver 402, in response to the gas pressure, to come in contact with the feed mechanism 410 to seal the gap 408 between the receiver 402 and the feed mechanism 410, and to forcibly push the feed mechanism 410 against the breech end of the barrel 420 to seal the gap 409 between the barrel 420 and the feed mechanism 410. FIG. 8 shows the sleeve 430 forcibly pushing the feed mechanism 410 forward against the barrel 420, closing, or sealing, the gap 408 between the sleeve 430 and the feed mechanism 410 and the gap 409 between the feed mechanism 410 and the barrel 420.

In the embodiment shown, the sleeve 430 has a central opening 434 therethrough that is smaller than duct 401 to provide access to at least a portion of an end surface 436 to be acted on by the gas pressure, even if the sleeve 434 is fully pushed back into the cavity. The central opening 434 can be the same size as the duct 401, larger than the duct 401, or smaller than the duct 401, as shown in FIG. 7/8, depending on the embodiment. Once the sleeve 434 is at least slightly moved forward, the entire end surface 436, including the annular ring that was exposed even if the sleeve 430 was fully retracted, can be acted on by the gas pressure. Some embodiments may configure the shape of the cavity to allow the gas pressure to act on a larger portion of the end surface 436 of the sleeve 430 even if the sleeve 430 is fully retracted into the cavity, such as a contoured back surface of the cavity, a chamfered back, a spacer, or some other mechanism to make sure that the end surface 436 of the sleeve 430 doesn't seal against the back of the cavity. So the sleeve is configured to slide in response to the gas pressure on an end surface 436 of the sleeve 430 opposite from the feed mechanism 410, to make contact between the face 432 of the sleeve 430 and the feed mechanism 410.

In another embodiment, the sleeve includes a face toward the feed mechanism with a central opening therethrough that is smaller than an inside diameter of the sleeve, and the sleeve is configured to slide in response to the gas pressure on an inside of the face of the sleeve, to make contact between the face of the sleeve and the feed mechanism. In other embodiments, the duct may extend out from the receiver and the sleeve may slide over the duct. In such an embodiment where the sleeve is positioned over an end portion of the gas duct of the receiver, the sleeve may have a face with a central opening therethrough having a size smaller than an inside diameter of the duct so that the sleeve can slide over the end portion of the gas duct, in response to the gas pressure on an inside of the face of the sleeve, to make contact between the face of the sleeve and the feed mechanism. In some such embodiments, a ring seal may be positioned within an interior peripheral groove within the sleeve and be configured to closely mate to and slide over the end portion of the duct. In other such embodiments, a ring seal may be positioned within an exterior peripheral groove around the end portion of the duct, and be configured to closely mate to an inside diameter of the sleeve, and the sleeve is configured to slide over the ring seal.

Figure 9:
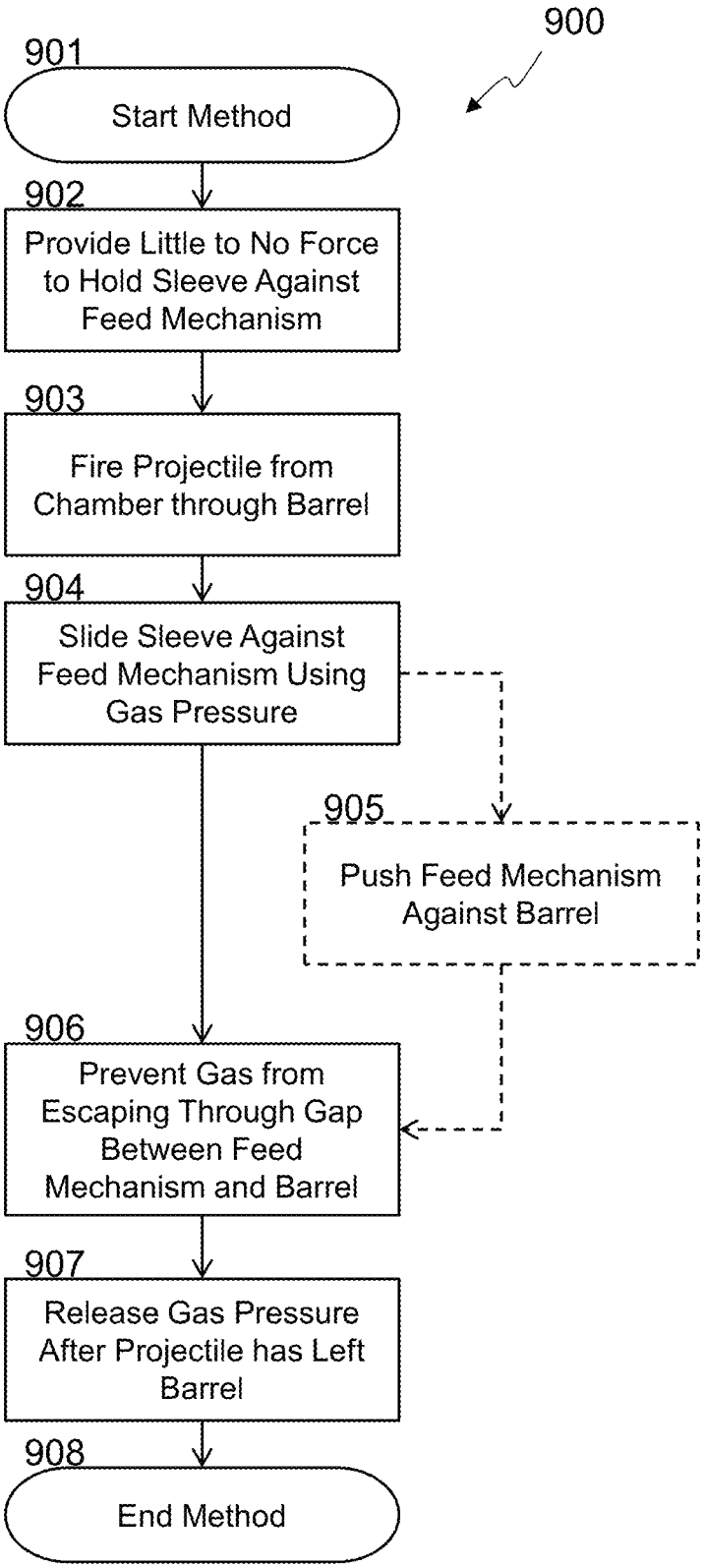
FIG. 9 is a flowchart of an embodiment of a method to seal a gap between a feed mechanism and a barrel of a projectile launching device.

FIG. 9 is a flowchart 900 of an embodiment of a method to seal a gap between a feed mechanism and a barrel of a projectile launching device. The method begins at block 901 and continues at block 902 by providing little to no force to hold a sleeve in contact with the feed mechanism before firing a projectile from the projectile launching device. In some embodiments, the sleeve may be in contact with the feed mechanism before the projectile is fired due to a slight bias from a spring, gravity, changes in atmospheric pressure, or some other process, but little to no force is holding the sleeve against the feed mechanism.

At block 903, the projectile is fired from a chamber of the feed mechanism through the barrel. In some embodiments, this may include inserting a shell, including gun powder and a bullet to act as the projectile, into a chamber of the feed mechanism, and igniting the gun powder to fire the bullet. In other embodiments, this may include providing gas from a pressurized gas reservoir that is a part of, or is coupled to, the projectile launching device, into the chamber to create the gas pressure to fire the projectile. So in at least one embodiment, the firing includes releasing compressed gas into the chamber of the feed mechanism behind the projectile, where the projectile is a paint ball, a tear gas ball, a pepper gas ball, a bean bag, or a rubber bullet. Depending on the embodiment, gas pressure can be created in front of the projectile by the rapid movement of the projectile from the chamber into the barrel. Any gas pressure used to fire the projectile and/or created in response to the firing of the projectile can be referred to as the gas pressure created by the firing of the projectile. So, the gas pressure can be created by one or more of by a compressed airstream ahead of the bullet moving from the chamber into the barrel, exploding gas from the ignited gun powder, compressed gas, or some other operation.

The gas pressure is used to provide force on the sleeve at block 904 to slide the single-piece sleeve toward the feed mechanism, substantially using gas pressure created by the firing of the projectile, and to push the sleeve against the feed mechanism to seal the gap between the feed mechanism and the barrel. In some embodiments, this includes applying force from gas pressure on an end surface of the sleeve opposite from the feed mechanism to forcibly slide the sleeve against the feed mechanism. In some embodiments, this includes applying force from the gas pressure on an inside surface of a face of the sleeve that is created by a central opening through the face having a size less than an inner diameter of the sleeve. In some embodiments block 904 is accomplished at least in part by sliding the sleeve over a breech end portion of the barrel. Some embodiments also include providing gas between the breech end portion of the barrel and an inner diameter of the sleeve to create the gas pressure in a space between a muzzle-facing surface of the sleeve and a recessed circular groove around the breech end portion of the barrel, and applying force from gas pressure on the muzzle-facing surface of the sleeve to forcibly slide the sleeve against the feed mechanism.

In some embodiments, the feed mechanism is pushed against the barrel at optional block 905 by the sleeve which is located on the opposite side of the feed mechanism from the barrel. In some of those embodiments, the sleeve slides within a cavity of a receiver located on the opposite side of the feed mechanism from the barrel. In some embodiments, the sleeve slides over an end portion of a gas duct located on the opposite side of the feed mechanism from the barrel. Some embodiments slide the sleeve by providing gas through the gas duct and through a central opening of a face of the sleeve into the chamber to create the gas pressure to fire the projectile, and applying force from gas pressure on an inside surface of the face of the sleeve to forcibly slide the sleeve against the feed mechanism.

Gas is prevented from escaping through the gap between the feed mechanism and the barrel at block 906. In some embodiments, gas is also prevented from escaping through a gap between the receiver and the feed mechanism. At block 907, the gas pressure on the sleeve that forcibly maintained the sleeve in a position to seal the gap between the feed mechanism and the barrel is released, so that little to no force to hold the sleeve in contact with the feed mechanism is provided after the projectile has left the barrel. Some embodiments with a rotating cylinder feed mechanism also include rotating the feed mechanism from a first position to a second position, where the first position of the feed mechanism aligns the chamber of the feed mechanism with the barrel, and the second position of the feed mechanism aligns another chamber containing another projectile with the barrel. The method ends at block 908.

The flowchart and/or block diagrams in the figures help to illustrate the architecture, functionality, and operation of possible implementations of systems, methods and projectile launching devices of various embodiments. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by various mechanical structures or by flow of gas, plasma, or other material.

Examples of various embodiments are described in the following paragraphs:

An example gun includes a frame, a barrel, including a bore therethrough, and held in position by the frame, a cylinder rotatably attached to the frame in close proximity to a breech end portion of the barrel, the cylinder having multiple chambers and configured to sequentially and longitudinally align a chamber with the bore of the barrel, and a sleeve slidingly positioned over the breech end portion of the barrel, the sleeve having a face with a central opening therethrough, the central opening having a size less than an inner diameter of the sleeve, but no smaller than a diameter of the bore through the barrel. In the example gun, the sleeve is configured to slide back, substantially in response to gas pressure, until the face of the sleeve is forcibly maintained in contact with the cylinder to eliminate a gap between the cylinder and the barrel. In some example guns, in response to reduced gas pressure, the sleeve is configured to no longer be forcibly maintained in contact with the cylinder. Some example guns include an enlargement in a breech end portion of the bore of the barrel, where a rear size of the enlargement is larger than the central opening through the face of the sleeve. In some example guns, the gas pressure is generated by one or more of a compressed airstream ahead of a projectile moving from the chamber into the barrel or expanding gas propelling the projectile through the bore of the barrel. In some example guns, the inner diameter of the sleeve is closely mated to the breech end portion of the barrel. Some example guns also include a ring seal positioned between the sleeve and the frame or the breech end portion of the barrel. In some example guns, the ring seal includes a split ring. Some example guns also include a ring seal positioned within an interior peripheral groove within the sleeve, where the ring seal is configured to closely mate to and slide over the breech end portion of the barrel. Some example guns also include a ring seal positioned within an exterior peripheral groove around the sleeve, where the ring seal is configured to closely mate to and slide within a recessed circular groove around the breech end portion of the barrel. Some example guns also include a ring seal positioned within an exterior peripheral groove around the breech end portion of the barrel, where the ring seal is configured to closely mate to the inside diameter of the sleeve, and the sleeve is configured to slide over the ring seal. Some example guns also include a chamfered outer edge on an end of the sleeve adjacent to the cylinder. Any combination of the examples of this paragraph may be used in embodiments.

An example method to seal a gap between a feed mechanism and a barrel of a projectile launching device includes providing little to no force to hold a sleeve in contact with the feed mechanism before firing a projectile from the projectile launching device, firing the projectile from a chamber of the feed mechanism through the barrel, sliding a sleeve back from the barrel, substantially using gas pressure created by the firing of the projectile, until a face of the sleeve makes contact with the feed mechanism to seal the gap between the feed mechanism and the barrel, and preventing gas from escaping through the gap between the feed mechanism and the barrel. Some example methods also include releasing the gas pressure on the sleeve that forcibly maintained the sleeve in a position to seal the gap between the feed mechanism and the barrel so that little to no force to hold the sleeve in contact with the feed mechanism is provided after the projectile has left the barrel. Some example methods also include applying the backward force from the gas pressure on an inside surface of the face of the sleeve, where the inside surface of the face of the sleeve is created by a central opening through the face having a size less than an inner diameter of the sleeve but no smaller than about a diameter of a bore through the barrel. Some example methods also include inserting a shell into a chamber of the feed mechanism, the shell comprising gun powder and a bullet, and igniting the gun powder to fire the bullet, where the projectile comprises the bullet. In some example methods the gas pressure is created by one or more of by a compressed airstream ahead of the bullet moving from the chamber into the barrel or exploding gas from the ignited gun powder. In some example methods the firing comprises releasing compressed gas into the chamber of the feed mechanism behind the projectile, where the projectile is a paint ball, a tear gas ball, a pepper gas ball, a bean bag, or a rubber bullet. Some example methods also include rotating the feed mechanism from a first position to a second position, wherein the feed mechanism comprises a rotating cylinder, where the first position of the feed mechanism aligns the chamber of the feed mechanism with the barrel, and the second position of the feed mechanism aligns another chamber containing another projectile with the barrel. Any combination of the examples of this paragraph may be used in embodiments.

An example projectile launching device includes a barrel with a bore through the barrel, the barrel having a breach end opposite of a muzzle end, a feed mechanism with a chamber to hold a projectile, positioned at the breach end of the barrel, wherein the feed mechanism is moveable between a first position and a second position, wherein the chamber is not aligned with the barrel in the first position and the chamber is aligned with the barrel in the second position to facilitate firing the projectile from the chamber through the barrel, and wherein the feed mechanism is positioned to create a gap between the barrel and the feed mechanism in at least the second position, and a single-piece sleeve adapted to forcibly slide into a position in contact with the feed mechanism, in response to gas pressure created in firing the projectile from the chamber through the barrel, to seal the gap between the barrel and the feed mechanism, where the sleeve is no longer forcibly maintained in the position in contact with the feed mechanism after the projectile has exited the muzzle end of the barrel and the gas pressure drops. In some example projectile launching devices the sleeve also includes a chamfered outer edge on an end of the sleeve adjacent to the feed mechanism. In some example projectile launching devices the feed mechanism comprises a rotating cylinder having one or more other chambers, including one chamber that, in the first position of the feed mechanism, is aligned with the barrel. In some example projectile launching devices the sleeve is positioned over a breach end portion of the barrel, the sleeve having a face with a central opening therethrough having a size no smaller than about a diameter of the bore through the barrel, where the sleeve is configured to slide over the breech end portion of the barrel, in response to the gas pressure, until the face of the sleeve makes contact with the feed mechanism. In some example projectile launching devices the chamber is adapted to hold a shell comprising gun powder and the projectile, and wherein the gas pressure created in firing the projectile comprises one or more of hot combustion gas from the gun powder or a compressed airstream ahead of the projectile moving from the chamber into the barrel. Some example projectile launching devices also include an enlargement in a breech end portion of the bore of the barrel, where a rear size of the enlargement is larger than the central opening through the face of the sleeve. In some example projectile launching devices the central opening is smaller than an inner diameter of the sleeve, and the gas pressure acts on an inner surface of the face of the sleeve to forcibly slide the sleeve into the position in contact with the feed mechanism. In some example projectile launching devices an inner diameter of the sleeve is closely mated to the breech end portion of the barrel. Some example projectile launching devices also include a ring seal positioned between the sleeve and another part of the projectile launching device to prevent gas from passing between the sleeve the other part of the projectile launching device. In some example projectile launching devices the ring seal comprises a split ring. Some example projectile launching devices also include a ring seal positioned within an interior peripheral groove within the sleeve, where the ring seal is configured to closely mate to and slide over the breech end portion of the barrel. Some example projectile launching devices also include a ring seal positioned within an exterior peripheral groove around the sleeve, where the ring seal is configured to closely mate to and slide within a recessed circular groove around the breech end portion of the barrel. Some example projectile launching devices also include a muzzle-facing surface of the sleeve, where the gas pressure causes gas to flow between the feed mechanism and the breech end of the barrel and between the breech end portion of the barrel and an inner diameter of the sleeve to pressurize gas in a space between the muzzle-facing surface of the sleeve and the recessed circular groove around the breech end portion of the barrel and the pressurized gas in the space acts on the muzzle-facing surface of the sleeve to forcibly slide the sleeve into the position in contact with the feed mechanism.

Some example projectile launching devices also include a spacing mechanism to create the space between the muzzle-facing surface of the sleeve and the recessed circular groove around the breech end portion of the barrel. In some example projectile launching devices the spacing mechanism comprises a spring washer. In some example projectile launching devices the spacing mechanism comprises a difference between a contour of the muzzle facing surface of the sleeve and a shape of the recessed circular groove around the breech end portion of the barrel. Some example projectile launching devices also include a ring seal positioned within an exterior peripheral groove around the breech end portion of the barrel, where the ring seal is configured to closely mate to the inside diameter of the sleeve, and the sleeve is configured to slide over the ring seal. Some example projectile launching devices also include a receiver positioned on an opposite side of the feed mechanism from the barrel, the receiver comprising a gas duct to provide the gas pressure, through the sleeve and into the chamber of the feed mechanism, to fire the projectile, where the sleeve is positioned on an opposite side of the feed mechanism from the barrel, and the sleeve is configured to slide, in response to the gas pressure, to come in contact with the feed mechanism and to forcibly push the feed mechanism against the breech end of the barrel to seal the gap between the barrel and the feed mechanism. Some example projectile launching devices also include a pressurized gas reservoir coupled to the gas duct of the receiver. Some example projectile launching devices also include a ring seal positioned between the sleeve and the receiver. In some example projectile launching devices the ring seal comprises a split ring. In some example projectile launching devices the sleeve is positioned over an end portion of the gas duct of the receiver, the sleeve having a face with a central opening therethrough having a size smaller than an inside diameter of the duct, where the sleeve is configured to slide over the end portion of the gas duct, in response to the gas pressure on an inside of the face of the sleeve, to make contact between the face of the sleeve and the feed mechanism. Some example projectile launching devices also include a ring seal positioned within an interior peripheral groove within the sleeve, where the ring seal is configured to closely mate to and slide over the end portion of the duct. Some example projectile launching devices also include a ring seal positioned within an exterior peripheral groove around the end portion of the duct, where the ring seal is configured to closely mate to an inside diameter of the sleeve, and the sleeve is configured to slide over the ring seal. In some example projectile launching devices the sleeve is positioned in a cavity of the receiver that is pneumatically coupled to the duct, where the sleeve is configured to slide within the cavity, in response to the gas pressure, to make contact with the feed mechanism. Some example projectile launching devices also include a ring seal positioned within an exterior peripheral groove around the sleeve, where the ring seal is configured to closely mate to and slide within cavity of the receiver. In some example projectile launching devices the sleeve comprises a face toward the feed mechanism with a central opening therethrough that is smaller than an inside diameter of the sleeve, where the sleeve is configured to slide in response to the gas pressure on an inside of the face of the sleeve, to make contact between the face of the sleeve and the feed mechanism. In some example projectile launching devices the sleeve is configured to slide in response to the gas pressure on an end surface of the sleeve opposite from the feed mechanism, to make contact between the face of the sleeve and the feed mechanism. Any combination of the examples of this paragraph may be used in embodiments.

An example method to seal a gap between a feed mechanism and a barrel of a projectile launching device includes providing little to no force to hold a sleeve in contact with the feed mechanism before firing a projectile from the projectile launching device, firing the projectile from a chamber of the feed mechanism through the barrel, sliding a single-piece sleeve toward the feed mechanism, substantially using gas pressure created by the firing of the projectile, to push the sleeve against the feed mechanism to seal the gap between the feed mechanism and the barrel, and preventing gas from escaping through the gap between the feed mechanism and the barrel. Some example methods include releasing the gas pressure on the sleeve that forcibly maintained the sleeve in a position to seal the gap between the feed mechanism and the barrel so that little to no force to hold the sleeve in contact with the feed mechanism is provided after the projectile has left the barrel. Some example methods include comprising applying force from the gas pressure on an inside surface of a face of the sleeve, where the inside surface of the face of the sleeve is created by a central opening through the face having a size less than an inner diameter of the sleeve. Some example methods include applying force from the gas pressure on an end surface of the sleeve opposite of the feed mechanism. In some example methods wherein the sliding the sleeve toward the feed mechanism further comprises sliding the sleeve over a breech end portion of the barrel. Some example methods include providing gas between the breech end portion of the barrel and an inner diameter of the sleeve to create the gas pressure in a space between a muzzle-facing surface of the sleeve and a recessed circular groove around the breech end portion of the barrel, and applying force from gas pressure on the muzzle-facing surface of the sleeve to forcibly slide the sleeve against the feed mechanism. Some example methods include pushing the feed mechanism against the barrel, where the sleeve is positioned on an opposite side of the feed mechanism from the barrel. In some example methods the sliding the sleeve toward the feed mechanism further comprises sliding the sleeve over an end portion of a gas duct, where the gas duct is positioned on an opposite side of the feed mechanism from the barrel. Some example methods include providing gas through the gas duct and through a central opening of a face of the sleeve into the chamber to create the gas pressure to fire the projectile, and applying force from gas pressure on an inside surface of the face of the sleeve to forcibly slide the sleeve against the feed mechanism. In some example methods the sliding the sleeve toward the feed mechanism further comprises sliding the sleeve through a cavity of a receiver, where the receiver is positioned on an opposite side of the feed mechanism from the barrel. Some example methods include providing gas into the cavity of the receiver and through the sleeve into the chamber to create the gas pressure to fire the projectile, and applying force from gas pressure on an end surface of the sleeve opposite from the feed mechanism to forcibly slide the sleeve against the feed mechanism. Some example methods include inserting a shell into a chamber of the feed mechanism, the shell comprising gun powder and a bullet, and igniting the gun powder to fire the bullet, where the projectile comprises the bullet. In some example methods the gas pressure is created by one or more of by a compressed airstream ahead of the bullet moving from the chamber into the barrel or exploding gas from the ignited gun powder. In some example methods the firing comprises releasing compressed gas into the chamber of the feed mechanism behind the projectile, where the projectile is a paint ball, a tear gas ball, a pepper gas ball, a bean bag, or a rubber bullet. Some example methods include rotating the feed mechanism from a first position to a second position, wherein the feed mechanism comprises a rotating cylinder, where the first position of the feed mechanism aligns the chamber of the feed mechanism with the barrel, and the second position of the feed mechanism aligns another chamber containing another projectile with the barrel. Any combination of the examples of this paragraph may be used in embodiments.

As used in this specification and the appended claims, the singular forms "a", "an", and "the" include plural referents unless the content clearly dictates otherwise. Thus, for example, reference to an element described as "a monitored volume" may refer to a single monitored volume, two monitored volumes, or any other number of monitored volumes. As used in this specification and the appended claims, the term "or" is generally employed in its sense including "and/or" unless the content clearly dictates otherwise. As used herein, the term "coupled" includes direct and indirect connections. Moreover, where first and second devices are coupled, intervening devices including active devices may be located there between. Unless otherwise indicated, all numbers expressing quantities of elements, percentages, and so forth used in the specification and claims are to be understood as being modified in all instances by the term "about." Interpretation of the term "about" is context specific, but in the absence of other indications, should generally be interpreted as ±5% of the modified quantity, measurement, or distance. Any element in a claim that does not explicitly state "means for" performing a specified function, or "step for" performing a specified function, is not to be interpreted as a "means" or "step" clause as specified in 35 U.S.C. §112(f).

The description of the various embodiments provided above is illustrative in nature and is not intended to limit this disclosure, its application, or uses. Thus, different variations beyond those described herein are intended to be within the scope of embodiments. Such variations are not to be regarded as a departure from the intended scope of this disclosure. As such, the breadth and scope of the present disclosure should not be limited by the above-described exemplary embodiments, but should be defined only in accordance with the following claims and equivalents thereof.

What is claimed is:

1. A projectile launching device comprising:

a barrel with a bore through the barrel, and a breach end opposite of a muzzle end;

a feed mechanism, with a chamber to hold a projectile, positioned at the breach end of the barrel, and moveable between a first position with the chamber and the barrel unaligned, and a second position with the chamber and the barrel aligned;

a receiver positioned on an opposite side of the feed mechanism from the barrel, the receiver comprising a gas duct to convey gas into the chamber to fire the projectile; and a sleeve, slidingly coupled to the receiver, and adapted to forcibly slide into a position in contact with the feed mechanism, in response to pressure from the gas conveyed through the gas duct, to seal a first gap between the receiver and the feed mechanism.

2. The projectile launching device of claim 1, wherein the feed mechanism is adapted to slide into contact with the breech end of the barrel, in response to force from the sleeve, to seal a second gap between the feed mechanism and the barrel.

3. The projectile launching device of claim 1, wherein the feed mechanism comprises a rotating cylinder having one or more other chambers, including one other chamber that, in the first position of the feed mechanism, is aligned with the barrel.

4. The projectile launching device of claim 1, wherein the feed mechanism comprises a sliding block.

5. The projectile launching device of claim 1, further comprising a pressurized gas reservoir coupled to the gas duct of the receiver.

6. The projectile launching device of claim 1, the sleeve adapted to slide over an end portion of the gas duct of the receiver to make contact with the feed mechanism.

7. The projectile launching device of claim 6, the sleeve including a face on the feed mechanism end of the sleeve, the face having a central opening therethrough that is smaller than an inside diameter of the gas duct.

8. The projectile launching device of claim 6, further comprising a ring seal positioned in an interior peripheral groove within the sleeve;

wherein the ring seal is configured to closely mate to and slide over the end portion of the gas duct.

9. The projectile launching device of claim 6, further comprising a ring seal positioned in an exterior peripheral groove around the end portion of the gas duct;

wherein the ring seal is configured to closely mate to an inside diameter of the sleeve, and the sleeve is configured to slide over the ring seal.

10. The projectile launching device of claim 1, further comprising a cavity in the receiver, pneumatically coupled to the gas duct, to hold the sleeve, the sleeve adapted to slide in the cavity to make contact with the feed mechanism.

11. The projectile launching device of claim 10, further comprising a ring seal positioned between an interior surface of the cavity and an exterior surface of the sleeve.

12. The projectile launching device of claim 10, wherein the sleeve comprises a face toward the feed mechanism with a central opening therethrough that is smaller than an inside diameter of the sleeve;

wherein the sleeve is configured to slide, in response to the pressure from the gas on an inside of the face of the sleeve, to make contact between the face of the sleeve and the feed mechanism.

13. The projectile launching device of claim 10, wherein the sleeve is configured to slide, in response to the pressure from the gas on an end surface of the sleeve opposite from the feed mechanism, to make contact between the sleeve and the feed mechanism.

14. A method to prevent gas from escaping from of a projectile launching device, the method comprising:

providing little to no force to hold a sleeve in contact with a feed mechanism before firing a projectile from the projectile launching device;

providing pressurized gas through a gas duct of a receiver into a chamber of the feed mechanism to fire a projectile through a barrel; and sliding a sleeve toward the feed mechanism, substantially using force from the pressurized gas, to push the sleeve against the feed mechanism to prevent the pressurized gas from escaping from between the feed mechanism and the receiver.

15. The method of claim 14, further comprising applying the force from the pressurized gas on an inside surface of a face of the sleeve;

wherein the inside surface of the face of the sleeve is created by a central opening through the face having a size less than an inner diameter of the sleeve.

16. The method of claim 14, further comprising applying the force from the pressurized gas on an end surface of the sleeve opposite of the feed mechanism.

17. The method of claim 14, further comprising pushing the feed mechanism against the barrel to prevent the pressurized gas from escaping from between the feed mechanism and the barrel.

18. The method of claim 14, wherein the sliding the sleeve toward the feed mechanism further comprises sliding the sleeve over an end portion of a gas duct.

19. The method of claim 14, wherein the sliding the sleeve toward the feed mechanism further comprises sliding the sleeve through a cavity of the receiver.

20. The method of claim 14, wherein the projectile comprises a paint ball, a tear gas ball, a pepper gas ball, a bean bag, or a rubber bullet.

* * * * *